United States Patent [19]

Meisen

[11] 4,214,462

[45] Jul. 29, 1980

[54] DEVICE FOR PRE-TREATING AND POST-TREATING A TEXTILE WEB

[75] Inventor: Klaus Meisen, Tönisvorst, Fed. Rep. of Germany

[73] Assignee: Kleinewefers GmbH, Krefeld, Fed. Rep. of Germany

[21] Appl. No.: 962,625

[22] Filed: Nov. 21, 1978

[30] Foreign Application Priority Data

Nov. 22, 1977 [DE] Fed. Rep. of Germany ..... 2751995

[51] Int. Cl.[2] ..... D06B 1/02

[52] U.S. Cl. ..... 68/205 R; 26/18.5

[58] Field of Search ..... 68/205 R, 5 D, 5 E, 68/44, 62, 158, 181 R; 34/159, 161, 162; 26/18.5; 28/281; 226/172

[56] References Cited

U.S. PATENT DOCUMENTS

| | | | |
|---|---|---|---|
| 130,133 | 8/1872 | Jenkins | 34/159 X |
| 2,488,997 | 11/1949 | Thornburg | 34/159 X |
| 2,494,731 | 1/1950 | Vincent et al. | 68/5 D |
| 3,950,802 | 4/1976 | Schiffer et al. | 68/181 R X |
| 4,004,879 | 1/1977 | Meier-Windhorst et al. | 68/181 R X |

*Primary Examiner*—Philip R. Coe

*Attorney, Agent, or Firm*—Becker & Becker, Inc.

[57] ABSTRACT

A device for pre-treating and post-treating a textile web, especially knitted goods, by means of two at least nearly vertical rows of deviating drums or rollers which are arranged one above the other and over which textile webs are passed in a zigzag fashion from below upwardly while the drums of one row are offset as to height relative to the drums of the other row by about the deviating drum diameter. Below the horizontal or slightly inclined sections of the textile web to be treated and between two successive deviating drums along the zigzag path of the textile web to be treated there is respectively arranged an endless supporting or carrying belt which is looped around the respective adjacent or pertaining deviating drum and at least one guiding drum or one guiding drum adjacent said respective deviating drum, each respective guiding drum by means of its mantle surface with the interposition of the textile web and belt engaging the respective—in the moving direction of the textile web—nearest deviating drum.

9 Claims, 5 Drawing Figures

DEVICE FOR PRE-TREATING AND POST-TREATING A TEXTILE WEB

The present invention relates to a device for pre-treating and post-treating a textile web, especially of a knitted fabric or of knitted goods with deviating rollers arranged in two vertical or nearly vertical rows one above the other, over which rollers the textile web is passed in a zigzag manner from below in upward direction while the rollers of one row are offset in vertical direction relative to the rollers of the other row by or approximately by the diameter of a deviating roller.

German Offenlegungsschrift No. 14 60 454 describes a device of the above mentioned type. With this device, by applying a film of washing liquid to the permeated textile web sections between two deviating rollers, and by pressing the washing liquid to the level of the deviating rollers, a squeezeless washing of the textile web is effected. The device is not limited to such wet treatment even though this wet treatment is the most frequently employed treatment in the device. Also steaming, relaxing or similar treatment may be effected in the device.

It is an object of the invention to improve the above mentioned known device so that the textile web sections between the deviating rollers are kept in a tension-free condition. In this connection, with a wet treatment it is to be taken into consideration that an additional liquid film is applied to the fully impregnated textile web. In particular, with knitted fabric and knitted goods, the liquid absorption capability is considerable, and if the additional liquid film is taken into consideration, the longitudinal tension in such knitted fabric or knitted goods is particularly high.

In order to overcome these drawbacks, the textile web may be supported by thinner supporting bars or rollers between the deviating rollers as has been disclosed for instance in German Offenlegungsschrift No. 24 25 374. Such members can contribute to the reduction in the longitudinal tension of the textile web. However, the present invention aims at a reduction in the longitudinal tension of the textile web which goes beyond the reduction in the longitudinal tension as set forth in said German Offenlegungsschrift No. 24 25 374.

This object and other objects and advantages of the invention will appear more clearly from the following specification in connection with the accompanying drawings, in which:

FIG. 1 is a side view of an embodiment according to the invention in which the supporting and carrier belts are looped around a deviating roller and a guiding roller.

FIGS. 2 and 3 respectively illustrate two embodiments of the arrangement of a guiding roller relative to their adjacent deviating roller in conformity with the invention .

Figure 1:
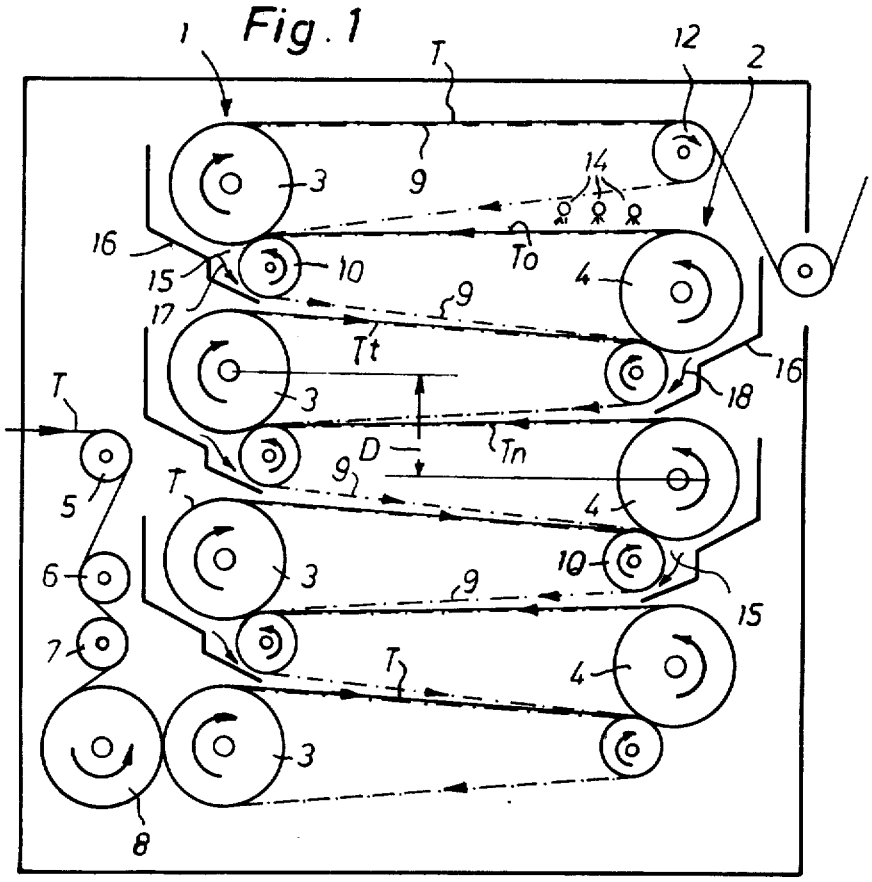

The device according to the prevent invention is characterized primarily in that below the horizontal or nearly horizontal textile web sections between two deviating rollers there is provided an endless supporting or carrier belt which is looped around one deviating roller each and around at least one guiding roller or about one guiding roller which with its mantle surface and the interposition of the textile web and the belt engages that deviating roller which is nearest when viewed in the moving direction of the textile web, or is looped around one of said deviating rollers located adjacent to the guiding roller.

It belongs to the state of the art, there to create a carrying or resting support where particularly high weights are to be supported or where longitudinal tensions have to be avoided. A continuous carrying and supporting belt which is taken along from the first to the last roller with the textile web, however, would have the drawback that the textile web rests only on the respective every other straight belt section on the supporting or carrier belt and with each second intermediate textile web section the carrying or supporting belt would be arranged above the textile web without supporting the latter. In addition thereto, this embodiment as well as other possible embodiments of supporting belts would have the important drawback that the deviating rollers at their respective outer mantle section would be covered up by the carrying or supporting belt so that as a result thereof, for instance when wet treating, the pressing through of liquids through the textile web at the level of the deviating rollers would be excluded or at least made difficult. Similar remarks apply to the steaming and relaxing of the textile web.

The possibility of respectively passing an endless belt about two guiding rollers located below the straight textile web sections would have the drawback that between each of the two guiding rollers and of the adjacent deviating roller a gap would form in which a textile web longitudinal tension occurs. Thus, the arrangement according to the present invention has the advantage that an uninterrupted or at least nearly uninterrupting support of the textile web upon the sucessive supporting and carrier belts is assured while nevertheless there is obtained the possibility of for instance carrying out a washing method in conformity with the above mentioned German Offenlegungsschrift 14 60 454, or a treatment of the textile web uniformly from both web sides.

According to still a further development of the invention, the diameter ratio of the guiding rollers to the deviating rollers is within the range of 1:2 to 1:3.

The guiding rollers may be arranged perpendicularly below the adjacent deviating rollers and in this connection may be adjustable in the longitudinal direction of the belt and in vertical direction. As a result thereof, it is possible on one hand to vary the tension of the supporting and carrier belt, whereas on the other hand the guiding rollers may be adjusted closer to or further from the deviating rollers below the latter. Advantageously, the guiding rollers should be so close but pressureless be so adjusted relative to the deviating rollers that the textile web in a continuous web guiding sequence will merge from the supporting or resting belt with the next deviating roller.

The same goal can be accomplished with a different embodiment of the present invention which is characterized primarily in that the guiding rollers are arranged laterally of the deflecting rollers and are likewise adjustable in the longitudinal and transverse direction of the belt. In this connection, the guiding rollers have their upper section located at the level of the lower deviating or deflecting roller range so that the axis of the guiding roller is horizontally as well as vertically spaced from the axis of the adjacent deflecting roller.

The guiding rollers are adjustable and are arrestable in their respective position. These guiding rollers do not serve as squeezing means in order to remove liquid from the textile web although this is possible.

Furthermore, the supporting or carrying belt can be passed about further guiding rollers located laterally and in the vicinity of the deflecting roller whereby the wedge-shaped gap between the deviating roller and the respective textile section moving toward the same can be kept large. Preferably, this additional lateral guiding roller is so arranged that the supporting and carrying belt looped around the deflecting roller will already at the central plane of the deflecting roller or shortly therebelow be conveyed from the additional guiding roller to the deviating roller.

Preferably, for steaming and relaxing, the supporting or transporting belt is water permeable. To this end, it may be provided with holes or perforations.

Of the various rollers of the device according to the invention, advantageously the guiding rollers are driven.

Referring now to the drawings in detail, the device according to FIG. 1 has two vertical rows of rollers 1,2 which comprise deviating rollers 3,4 of equal diameter. The two rows of rollers 1,2 are arranged in a predetermined spaced relationship from each other. The rollers of one row of rollers are offset as to height relative to the rollers of the other row of rollers by the diameter D of the rollers 3,4 so that the zigzag guided textile web T from below in upward direction by means of the device between the rollers 1,2 of the pertaining rows assume a horizontal position.

Figure 2:
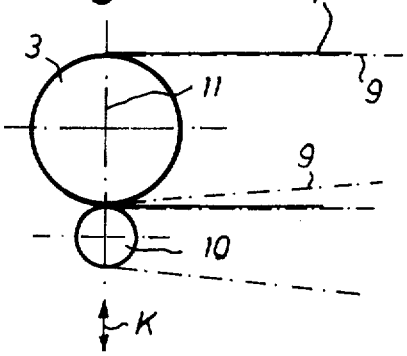

The textile web T is to this end over a roller 5 conveyed to a broad holder combination of the rollers 6,7 which are so adjustable that their looping angle is variable. By the broad holder combination, the textile web is guided toward an introducing roller 8 from which the textile web is conveyed to the first deviating roller of the device which forms the lowermost roller of the left hand row 1. Each deviating roller is looped around by a supporting or carrying belt 9 which as an endless belt is furthermore looped around a guiding roller 10 which latter as shown in FIG. 2 in connection with the embodiment of roller 3 is arranged on the vertical central plane 11 of the deviating roller 3 and is adjustable in the direction of the double arrow K with regard to said deviating roller 3, without in this connection positively exerting a pressure upon the textile web 10 and the supporting or carrying belt 9. It may be stated that it is possible to exert such a pressure if desired but this does not affect either the problem or the solution underlying the present invention.

By the arrangement of the supporting and carrying belt around the deflecting roller 3,4, it is assured that the textile web will rest over its entire length on the supporting or carrying belts and therefore, starting from the roller 8 will up to the exit roller 12 located at the level of the roller row 2 have an uninterrupted engagement or support which prevents the exertion of a longitudinal pull upon the textile web. This is particularly important for knitted fabric and knitted goods which are subjected to a wet treatment. As a result thereof, the surface of the rollers 3,4 (similar to the rollers 10) does not have to be a surface which is compatible to or gentle on the character of the textile web.

Figure 3:
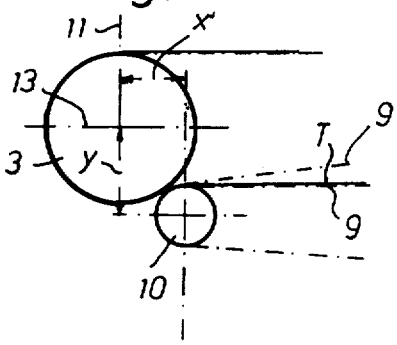

As will be seen from FIG. 3, the guiding rollers 10 may be arranged also at a distance x from the vertical central plane 11 and at a distance y from the horizontal central plane 13 of the deflecting roller 3,4. Also in this instance, the arrangement of the guiding roller 10 is such that the textile web is along a continuous manner guided from the belt section on the roller 10 on the belt section of the next belt on the roller 3,4. The diameter ratio of the guiding rollers 10 relative to the deflecting rollers 3,4 is within the range of 1:2 to 1:3.

Preferably, the guiding rollers 10 are driven and the support or carrying belts 9 simultaneously serve as driving belts for the deviating rollers 3,4.

Above the goods section To located between the two uppermost deflecting rollers 3,4 there are arranged spray nozzles 14 which apply treating fluid for instance washing liquid, as liquid film to the premeated textile web section. The washing liquid is at the level of the uppermost roller 3 pressed by the belt 9 which in the present instance is not or is only slightly water permeable, through the textile web into the chamber 15.

The treating liquid passes from the chamber 15 through spray and deviating plates 16 in the direction of the arrow 17, again as liquid film onto the next deeper textile web section Tt which extends toward the uppermost deviating roller 4. The treating fluid is there again pressed through the textile web 10 and passes in the direction of the arrow 18 toward the next deeper textile section Tn, etc.

For treatment other than washing, the support and carrying belt 9 may be provided with holes or perforations which gives the belt a certain permeability.

Figure 4:
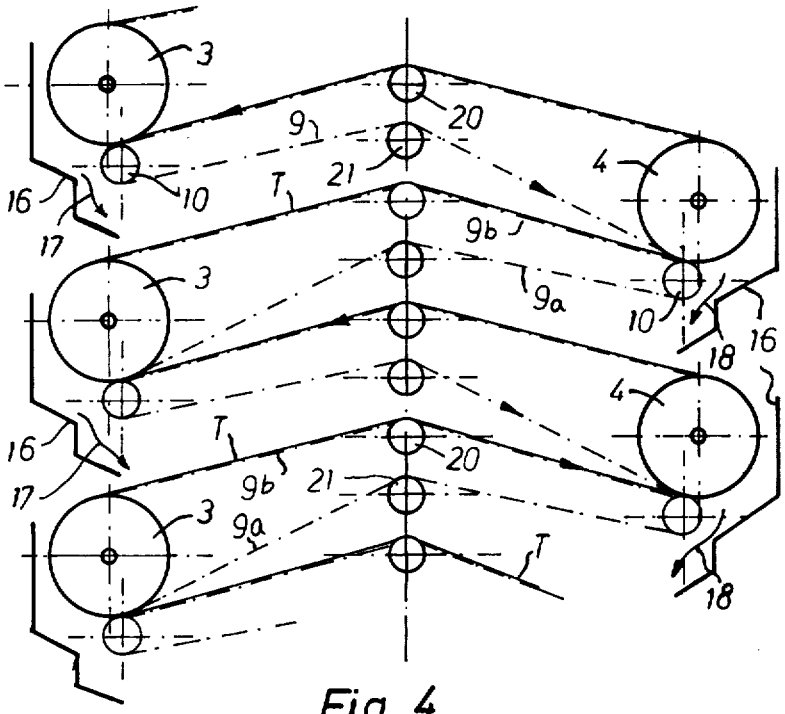
FIG. 4 illustrates a further embodiment of the invention with two additional supporting rollers for the supporting and carrier belts while a Christmas-tree like zigzag guiding of the the textile web is effected.

According to the embodiment illustrated in FIG. 4, again two rows of superimposed deflecting rollers 3,4 are provided while between the deflecting rollers there are provided pairs of supporting rollers 20, 21 over which the supporting or carrying belt 9 is placed with its lower strand **9*a* or its upper strand 9*b* on its way from the deviating rollers 3,4 to the pertaining guiding roller 10. The supporting rollers 20, 21 may be so arranged that the textile web T is horizontally guided between the rollers 3,4 or a Christmas-tree shaped zigzag course of the textile web as illustrated in FIG. 4 is obtained. The embodiment of FIG. 4 otherwise has the same parts which are arranged in the same manner as the device according to FIG. 1**.

Figure 5:
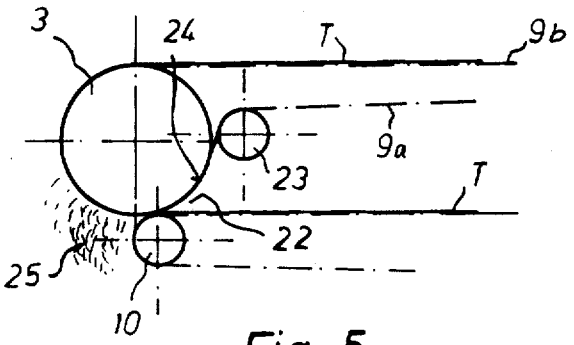
FIG. 5 is still another embodiment of the present invention with an additional guiding roller in the vicinity of the deviating roller looped around by the supporting and carrier belt.

According to the embodiment of FIG. 5, in order to increase the wedge-shaped inlet gap 22 between the textile web T and the lower strand **9*a* of the next belt 9, an additional guiding roller 23 is provided over which the lower strand 9*a* of the next belt 9 is passed. This lower strand 9*a* on its way between the additional guiding roller 23 and the deflecting roller 3** firmly rests above the textile web against said nearest belt.

According to the embodiment of FIG. 1, as well as according to FIG. 4, the textile web T rests over its entire length on the respective upper strand of the supporting or carrying belt 9 so that each side of the textile web can alternately be provided with treatment fluid. In particular, for woven and knitted fabric, a tension-free treatment not only with liquid but also with steam and chemicals can be effected.

Similar to the description in connection with FIG. 4, the textile web sections may extend at an incline between the deflecting rollers 3,4 in FIG. 1.

It is, of course, to be understood that the present invention is, by no means, limited to the specific showing in the drawings, but also comprises any modifications within the scope of the appended claims.

What is claimed is:

1. A device for pre-treating and post-treating a textile web, especially knitted goods, which includes in combination: two at least nearly vertical rows of deviating drums arranged one above the other in each row and adapted to recieve and convey the textile web to be treated along a zigzag path from below in upward direction, the drums of one row being offset as to height relative to the drums of the other row by substantially the diameter of a deviating drum, rotatable endless belts respectively arranged below the textile web path between each two successive deviating drums along the zigzag path of the textile web to be treated, and a plurality of guiding rolls respectively drivingly connected with said deviating drums, each of said endless belts being looped around a deviating drum and the respective guiding roll following the last mentiond deviating drum along the path of movement for the textile web to be treated, spray means and deflecting plates respectively arranged in a chamber laterally of and below said deviating drums, the lower end of said plates at at least the approximate level of the next lower deviating drum extending between the path of movement for the textile web to be treated and the next higher endless belt.

2. A device in combination according to claim 1, in which the diameter ratio of the guiding rolls to the deviating drums structurally is within the range of from 1:2 to 1:3.

3. A device in combination according to claim 1, in which said guiding rolls are respectively arranged substantially perpendicularly below the respective adjacent deviating drum and means by which rolls are adjustable and arrestable in vertical direction and in the longitudinal direction of the pertaining belt.

4. A device in combination according to claim 1, in which said guiding rolls are respectively arranged laterally of the lower region of the respective adjacent deviating drum and means by which rolls are adjustable in the longitudinal and transverse direction of said belt and are arrestable in the respective adjusted position.

5. A device in combination according to claim 1, which includes a plurality of additional guiding rolls respectively arranged laterally and in the vicinity of said deviating drums.

6. A device in combination according to claim 1, in which said endless belts are water permeable.

7. A device in combination according to claim 6, in which said endless belts are perforated.

8. A device in combination according to claim 1, which includes supporting rolls supporting said endless belts.

9. A device in combination according to claim 1, which includes spray means arranged between the two uppermost deviating drums for dispensing treating fluid upon and through a textile web when moving between said last mentioned two deviating drums.

* * * * *